US011642601B2

(12) United States Patent
Young et al.

(10) Patent No.: US 11,642,601 B2
(45) Date of Patent: May 9, 2023

(54) FOLDING CLIMBER

(71) Applicant: Radio Flyer Inc., Chicago, IL (US)

(72) Inventors: Matthew Young, Chicago, IL (US); Kyle Kenagy, Chicago, IL (US); Collin Ostergaard, Chicago, IL (US); Jacob Swan, Chicago, IL (US)

(73) Assignee: Radio Flyer Inc., Chicago, IL (US)

( * ) Notice: Subject to any disclaimer, the term of this patent is extended or adjusted under 35 U.S.C. 154(b) by 36 days.

(21) Appl. No.: 17/349,641

(22) Filed: Jun. 16, 2021

(65) Prior Publication Data

US 2021/0387101 A1 Dec. 16, 2021

Related U.S. Application Data

(60) Provisional application No. 63/039,661, filed on Jun. 16, 2020.

(51) Int. Cl.
*A63G 21/02* (2006.01)
*A63B 9/00* (2006.01)

(52) U.S. Cl.
CPC ..... *A63G 21/02* (2013.01); *A63G 2200/00* (2013.01)

(58) Field of Classification Search
CPC ..... A63B 9/00; A63H 33/00; A63H 33/04; A63H 33/044; A63H 33/008; A63G 21/00; A63G 21/02; E04B 1/344
USPC ..... 472/116; 482/34–36; 446/487–488
See application file for complete search history.

(56) References Cited

U.S. PATENT DOCUMENTS

| | | | | |
|---|---|---|---|---|
| 2,919,045 | A | 12/1959 | Waugh et al. | |
| 4,603,658 | A | 8/1986 | Gamsey | |
| 6,383,084 | B1 | 5/2002 | McEachen et al. | |
| 6,715,255 | B2 * | 4/2004 | Schipani | E04C 3/005 211/198 |
| 2006/0159868 | A1 * | 7/2006 | Hoberman | E04H 15/52 446/487 |
| 2012/0157266 | A1 * | 6/2012 | Todokoro | A63B 9/00 482/35 |
| 2020/0215449 | A1 * | 7/2020 | Rieber | F16C 11/04 |

FOREIGN PATENT DOCUMENTS

| | | |
|---|---|---|
| KR | 1020200097410 | 8/2020 |
| WO | WO2013011160 | 1/2013 |

OTHER PUBLICATIONS

International Search Report and Written Opinion issued to PCT/US21/37665 dated Nov. 4, 2021, 12 pages.

* cited by examiner

*Primary Examiner* — Kien T Nguyen
(74) *Attorney, Agent, or Firm* — Barnes & Thornburg LLP

(57) ABSTRACT

A folding play structure is provided. The play structure is convertible between a storage position and a use position, and has first, second, third and fourth sidewalls. A center beam is positioned between the first sidewall and the second sidewall. A first foldable frame structure joins one end of the first sidewall to one end of the second sidewall, and a second foldable frame structure joins the other end of the first sidewall to the other end of the second sidewall. A frame lock is provided and is prevented from moving when the play structure is in the use position to retain the structure in the use position. The structure has legs, a slide and a ladder.

17 Claims, 15 Drawing Sheets

FOLDING CLIMBER

CROSS-REFERENCE TO RELATED APPLICATIONS

This application claims the benefit of U.S. Provisional Patent Application No. 62/039,661 filed Jun. 16, 2020, which is expressly incorporated herein by reference and made a part hereof.

FEDERALLY SPONSORED RESEARCH OR DEVELOPMENT

Not Applicable.

TECHNICAL FIELD

The present subject matter relates to a folding climber, and more particularly, to a children's climber with accessories that folds between a use and folded orientation.

BACKGROUND

Children's climbers are known in the art. While such climbers according to the prior art provide a number of advantages, they nevertheless have certain limitations. The present disclosure seeks to overcome certain of those limitations and other drawbacks of the prior art, and to provide new features not heretofore available. A full discussion of the features and advantages of the present disclosure is deferred to the following detailed description, which proceeds with reference to the accompanying drawings.

SUMMARY

According to certain aspects of the present disclosure, the disclosed subject technology relates to a folding climber.

The disclosed technology further relates to a climber in the form of a children's play structure operable in a storage position and a use position.

The disclosed technology further relates to a play structure convertible between a storage position and a use position, the play structure comprising: a first sidewall having a first end and a second end; a second sidewall having a first end and a second end; a third sidewall between the first end of the first sidewall and the first end of the second sidewall, the third sidewall having a first end and a second end, the third sidewall further having a first rotating panel and a third rotating panel; a fourth sidewall between the second end of the first sidewall and the second end of the second sidewall, the fourth sidewall having a first end and a second end, the fourth sidewall having a second rotating panel and a fourth rotating panel; and, a center beam between the first sidewall and the second sidewall, wherein each of the first, second, third, and fourth rotating panels is configured to rotate about an axis of a corresponding vertical support, wherein the first rotating panel and the third rotating panel are in a first common plane when the play structure is in the use position, wherein the second rotating panel and the fourth rotating panel are in a second common plane when the play structure is in the use position, wherein the first rotating panel and the second rotating panel are in a third common plane when the play structure is in the storage position, wherein the third rotating panel and the fourth rotating panel are in a fourth common plane when the play structure is in the storage position, wherein the first common plane is generally parallel with the second common plane in the use position, and wherein the third common plane is generally parallel with the fourth common plan in the storage position.

The disclosed technology further relates to a play structure convertible between a storage position and a use position, the play structure comprising: a first sidewall; a second sidewall opposing the first sidewall; a center beam between the first sidewall and the second sidewall, wherein the first sidewall and second sidewall are disposed generally equidistant from the center beam in both the storage position and the use position; and, a plurality of panels, wherein at least two of the panels of the plurality of panels are perpendicular to a plane of the first sidewall in the use position, and wherein the at least two of the panels of the plurality of panels are parallel to the plane of the first sidewall in the storage position.

The disclosed technology further relates to a play structure convertible between a storage position and a use position, the play structure comprising: a first sidewall having a first end and a second end; a second sidewall opposing the first sidewall, the second sidewall having a first end and a second end; a first floor member adjacent the first sidewall; a second floor member adjacent the second sidewall; a center beam between the first floor member and the second floor member and, a first foldable frame structure joining the first end of the first sidewall to the first end of the second sidewall, and a second foldable frame structure joining the second end of the first sidewall to the second end of the second sidewall, wherein at least one of the first foldable frame structure and the second foldable frame structure has a frame lock, wherein the frame lock is prevented from movement when the play structure is in the use position, and wherein the frame lock can be moved when the play structure is in the storage position.

The disclosed technology further relates to a play structure wherein one of the first rotating panel and the third rotating panel has a locking arm that is able to rotate about an axis, and wherein the other of the first rotating panel and the third rotating panel has a lock receiver configured to receive the locking arm in the use position to lock the first and the third rotating panels together in the use position.

The disclosed technology further relates to a play structure wherein one of the second rotating panel and the fourth rotating panel has a locking arm that is able to rotate about an axis, and wherein the other of the second rotating panel and the fourth rotating panel has a lock receiver configured to receive the locking arm in the use position to lock the second and the fourth rotating panels together in the use position, and The disclosed technology further relates to a play structure wherein each of the first, second, third, and fourth rotating panels has a recess disposed on each respective panel opposite each panel's corresponding vertical support.

The disclosed technology further relates to a play structure wherein the recess of the first rotating panel and the recess of the third rotating panel receive a first support when the play structure is in the use position.

The disclosed technology further relates to a play structure wherein the recess of the second rotating panel and the recess of the fourth rotating panel receive a second support when the play structure is in the use position.

The disclosed technology further relates to a play structure wherein the first support and the second support are connected to the center beam.

The disclosed technology further relates to a play structure wherein the plurality of panels comprise a first panel, a second panel, a third panel and a fourth panel, and wherein the first and third panels are disposed at opposite ends of the center beam in the use position to the second and fourth panels.

The disclosed technology further relates to a play structure wherein each panel of the plurality of panels is configured to rotate about an axis of a vertical support, the rotation terminating at a position of each panel in the use position and the storage position, respectively.

The disclosed technology further relates to a play structure wherein each panel of the plurality of panels has a recess, wherein each panel of the plurality of panels is attached to a vertical support, and wherein the recess in each panel is disposed opposite the vertical support for each of the panels of the plurality of panels.

The disclosed technology further relates to a play structure further comprising a third sidewall between a first end the first sidewall and a first end of the second sidewall, and a fourth sidewall between a second end of the first sidewall and a second end of the second sidewall.

The disclosed technology further relates to a play structure wherein the third sidewall comprises a pair of upper supports, a pair of lower supports, opposing vertical supports, and a center member between the opposing vertical supports.

The disclosed technology further relates to a play structure further comprising a handle at a top of the center member.

The disclosed technology further relates to a play structure wherein one of the pair of upper supports, one of the pair of lower supports, one of the opposing vertical members, and the center member comprises a four bar linkage to assist in converting the play structure between the use position and the storage position.

The disclosed technology further relates to a play structure further comprising a frame lock secured to the center member, the frame lock positioned within a recess in the panels in the use position.

The disclosed technology further relates to a play structure wherein the first sidewall and the second sidewall are disposed generally equidistant from the center beam in both the storage position and the use position, and wherein the distance between the first sidewall and the center beam is greater in the use position than in the storage position.

The disclosed technology further relates to a play structure further comprising a ladder rotatably connected to the first sidewall in both the use position and the storage position, and a slide rotatably connected to the second sidewall in both the use position and the storage position.

The disclosed technology further relates to a play structure further comprising a recess adjacent at least one of the first foldable frame structure and the second foldable frame structure, the recess engaging the frame lock in the use position to prevent the frame lock from movement in the use position, the recess being moved from the frame lock in the storage position to allow the frame lock to move. has a frame lock, wherein the frame lock is prevented from movement when the play structure is in the use position, and wherein the frame lock can be moved when the play structure is in the storage position.

The disclosed technology further relates to a play structure that comprises a first sidewall and a second sidewall, each having a respective base, along with a center beam. In at least some of such embodiments, the first sidewall and the second sidewall are disposed equidistant from the center beam in both the storage position and the use position. In such embodiments, the distance between the first sidewall and the center beam is greater in the use position than in the storage position, and the base of the first sidewall is disposed beneath the center beam in the storage position.

The disclosed technology further relates to a play structure that comprises a first and second sidewall, each having a base, a center beam, and a plurality of side panels. In one or more embodiments, the first sidewall and second sidewall are disposed equidistant from the center beam in both the storage position and the use position, and at least two of the side panels of the plurality of side panels are perpendicular to the plane of the first sidewall in the use position. In at least some of such embodiments, at least two of the side panels of the plurality of side panels are parallel to the plane of the first sidewall and the axis of the center beam in the storage position, and at least two of the side panels of the plurality of side panels are disposed at opposite ends of the center beam in the use position.

The disclosed technology further relates to a play structure that comprises a first sidewall, having a first end and a second end, a second sidewall, having a first end and a second end, a third sidewall, having a first end and a second end, comprising a first rotating panel and a third rotating panel, and a fourth sidewall, having a first end and a second end, comprising a second rotating panel and a fourth rotating panel. The structure further comprises a center beam. In at least some embodiments, each of the first, second, third, and fourth rotating panels is configured to rotate about the axis of a corresponding vertical support. As these panels rotate, the plane of the first rotating panel and plane of the third rotating panel are the same when the play structure is in a use position, and the plane of the second rotating panel and plane of the fourth rotating panel are the same when the play structure is in a use position. When the play structure is in the storage position, the plane of the first rotating panel and plane of the second rotating panel are the same, and the plane of the third rotating panel and plane of the fourth rotating panel are the same.

It is understood that other embodiments and configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

To understand the present disclosure, it will now be described by way of example, with reference to the accompanying drawings in which embodiments of the disclosures are illustrated and, together with the descriptions below are incorporated in and constitute a part of this specification, and serve to explain the principles of the disclosure. In the drawings.

Figure 1:
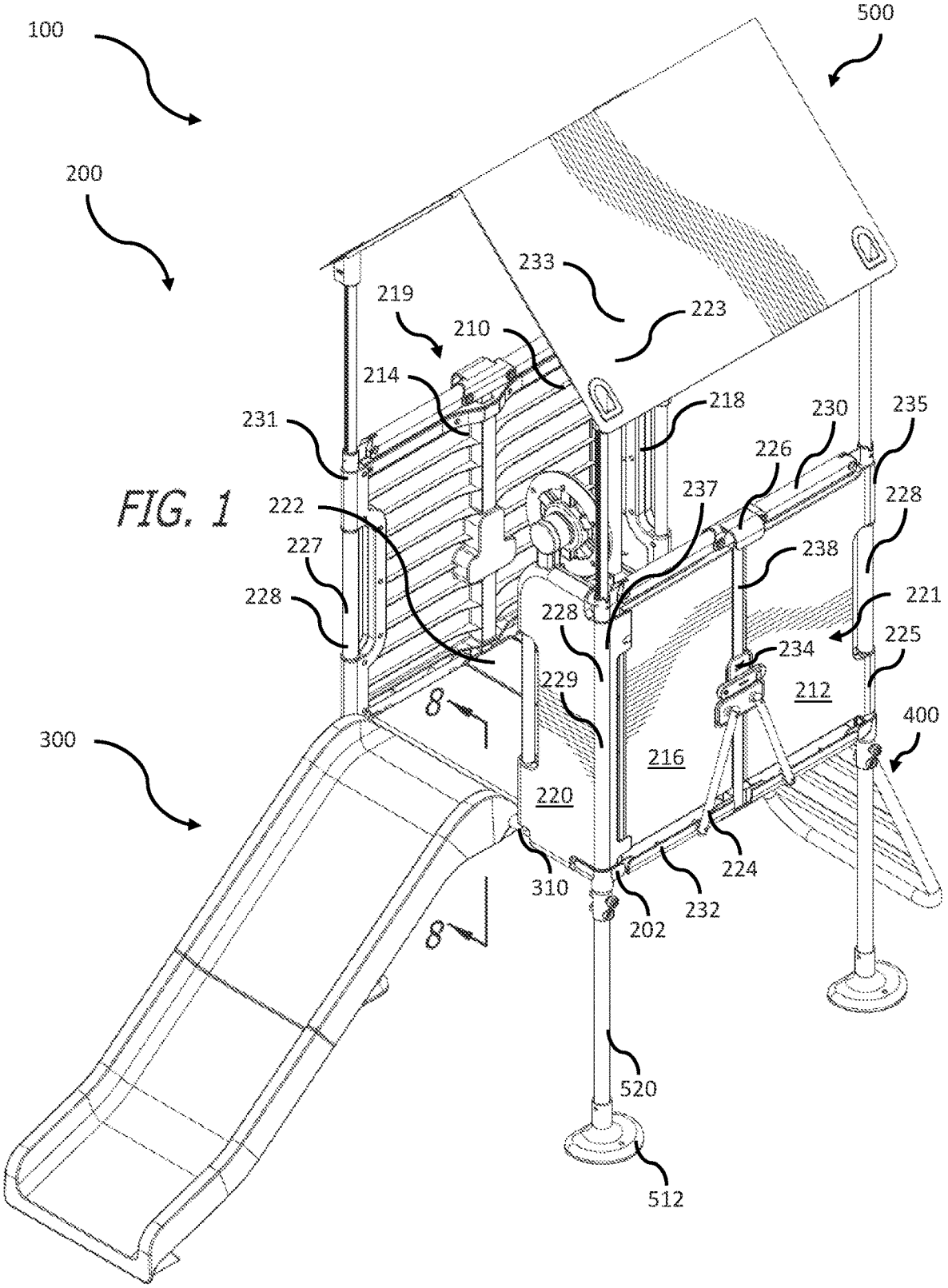
FIG. 1 is a front perspective view of a play structure in a use position having a slide, a ladder, and a main assembly according to the present disclosure.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

While this disclosure is susceptible of embodiments in many different forms, there is shown in the drawings and will herein be described in detail preferred embodiments with the understanding that the present disclosure is to be considered as an exemplification of the principles of the disclosure and is not intended to limit the broad aspect of the disclosure to the embodiments illustrated. It should be noted that the features illustrated in the drawings are not necessarily drawn to scale, and features of one embodiment may be employed with other embodiments as one of ordinary skill in the relevant art would recognize, even if not explicitly stated herein. Further, descriptions of well-known components and processing techniques may be omitted so as to not unnecessarily obscure the embodiments of the present disclosure. The examples used herein are intended merely to facilitate an understanding of ways in which the present disclosure may be practiced and to further enable those of ordinary skill in the art to practice the embodiments of the present disclosure. Accordingly, the examples and embodiments herein should not be construed as limiting the scope of the present disclosure, which is defined solely by the appended claims and applicable law.

Generally, this disclosure describes a folding play structure for children, where the play structure is specifically configured to allow an operator to fold the structure from a use position to a storage position.

Figure 2:
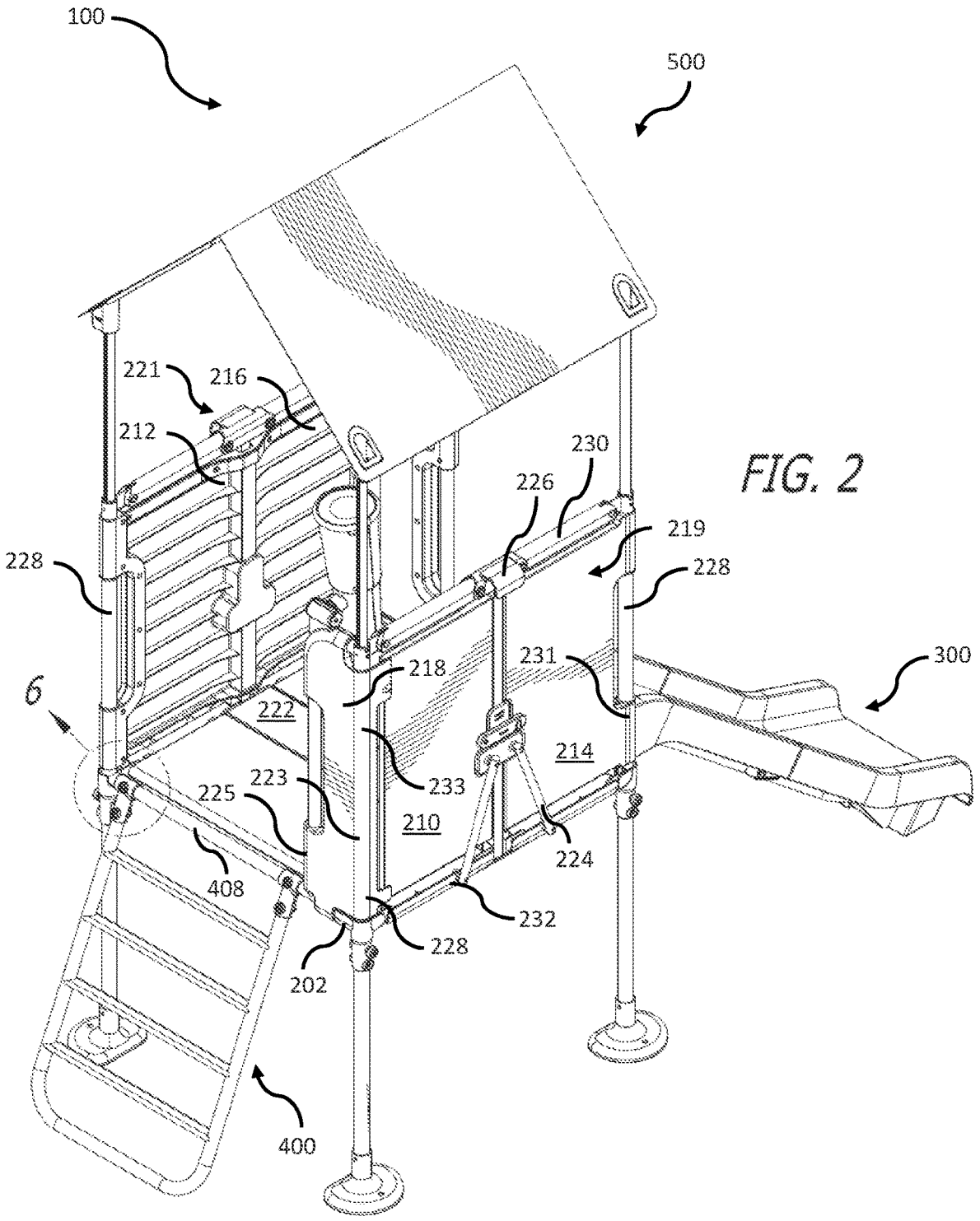
FIG. 2 is a rear perspective view of the play structure of FIG. 1 according to the present disclosure.

Referring now to the figures, and initially to FIGS. 1 and 2, there is shown a play structure 100 comprised of a main assembly 200, a slide assembly 300, a ladder assembly 400, and a roof assembly 500. FIGS. 1 and 2 depict the play structure 100 in the use position.

In one embodiment, the main assembly 200 comprises a first sidewall 218, a second sidewall 220 opposing the first sidewall 218, a third sidewall 219, and a fourth sidewall 221 opposing the third sidewall 219. The first sidewall 218 has a first end 223 and a second end 225; the second sidewall 220 has a first end 227 and a second end 229; the third sidewall 219 has a first end 231 and a second end 233; and, the fourth sidewall 221 has a first end 235 and a second end 237. The third sidewall 219 is preferably positioned between the first end 223 of the first sidewall 218 and the first end 227 of the second sidewall 220, and the fourth sidewall 221 is preferably positioned between the second end 225 of the first sidewall 218 and the second end 229 of the second sidewall 220.

In one embodiment, the third sidewall 219 has a first rotating panel 210 and a third rotating panel 214, and the fourth sidewall 221 has a second rotating panel 212 and a fourth rotating panel 216. Each of the rotating panels 210, 212, 214, and 216 have a first end and a second end, with the first end rotatably affixed to a vertical support member 228. The rotating panels 210, 212, 214, and 216 are configured to rotate about the axis of their corresponding vertical support members 228.

According to an illustrated embodiment, in the use position, each rotating panel is framed by an upper support 230, a lower support 232, a vertical support member 228, and a center frame member 238. The vertical support members 228 are disposed such that they define the first end 231 and a second end 233 of the third sidewall 219, and the first end 235 and a second end 237 of the fourth sidewall 220. Vertical support members 228 are further disposed at the first end 223 of the first sidewall 218, as well as the first end 227 of the second sidewall 220. As such, each of the third sidewall 219 and fourth sidewall 221 comprise a pair of the upper supports 230, pair of lower supports 232, a single center frame member 238, and a pair of vertical supports 228. These items form a four bar linkage system to assist in converting the play structure from its use position to its storage position, and the components of this linkage system are free to move relative to one another through a series of hinged connections. In at least some embodiments, a four bar linkage forms a first foldable frame structure, joining the first end 223 of the first sidewall 218 to the first end 227 of the second sidewall 220. In other or the same embodiments, a four bar linkage forms a second foldable frame structure, joining the second end 225 of the first sidewall 218 to the second end 229 of the second sidewall 220. In at least some of such embodiments having a first and/or second foldable frame structure, the center frame member 238 of the four bar linkage further includes a frame lock 234.

In at least some embodiments, the center frame members 238 are connected at distal ends to a center beam 222, while the lower support 232 is rotatably connected to both the center frame member 238 at a first end, and a corner member 202 at a second end. The corner member 202 forms a fixed connection with the vertical support members 228. In the use position, the fixed first side wall 218 is affixed to support shaft 408, and second side wall 220 is affixed to support shaft 310, each at their lower bounds.

Figure 9:
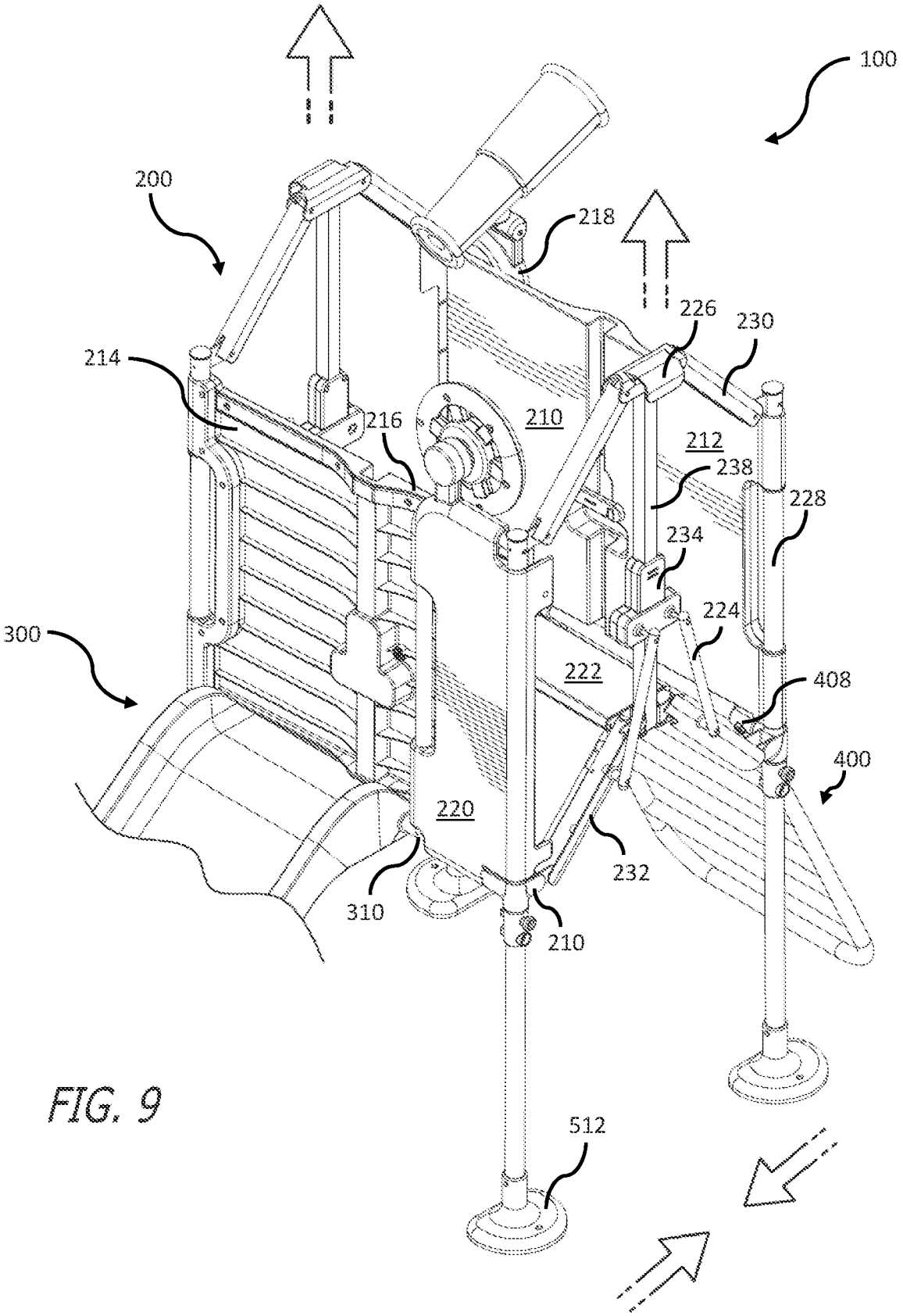
FIG. 9 is a front perspective view of the play structure of FIG. 1 in transition from the use position to the storage position according to the present disclosure.
Figure 11:
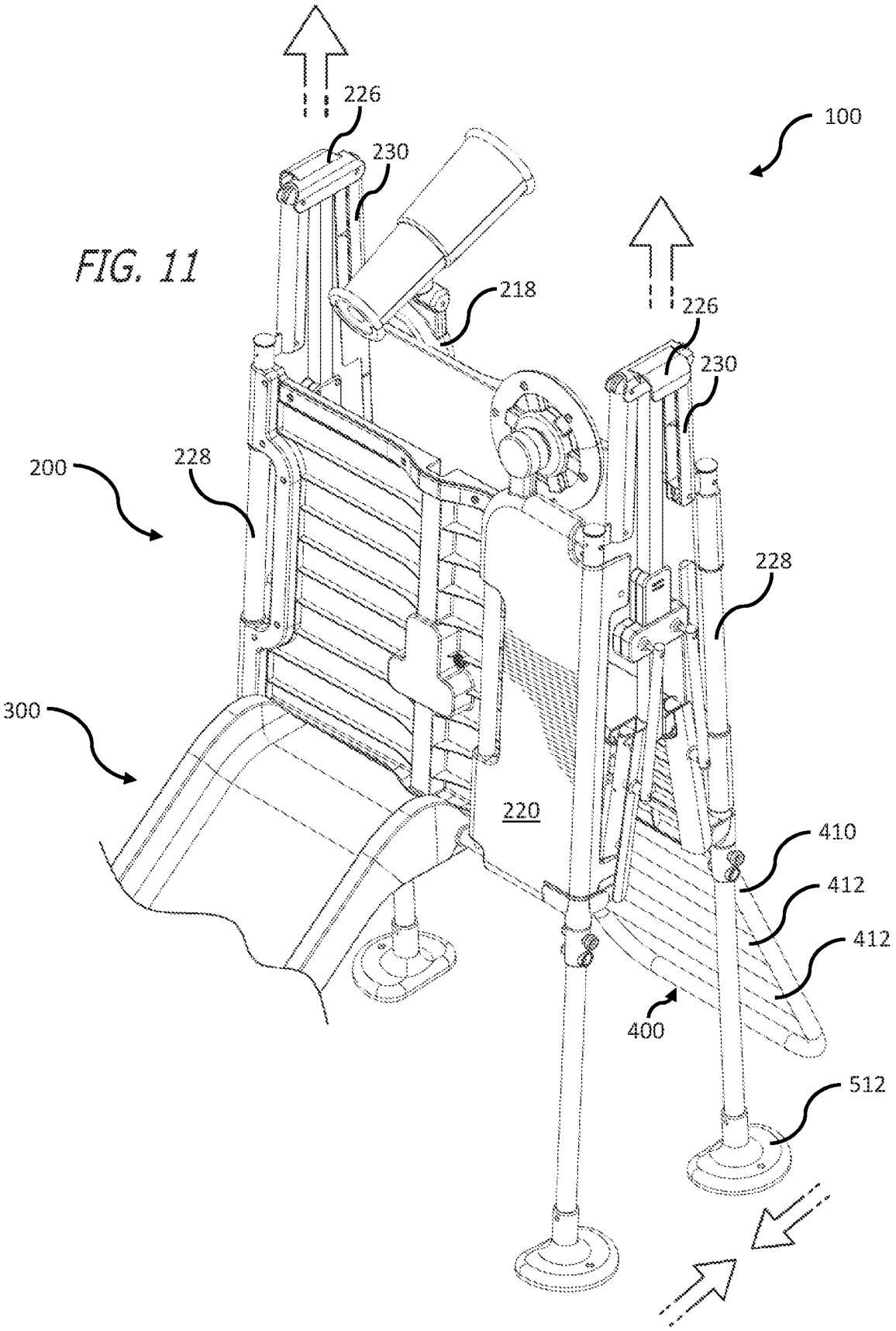
FIG. 11 is a front perspective view of the play structure of FIG. 1 in transition from the use position to the storage position according to the present disclosure.

As depicted in the embodiment illustrated in FIGS. 1 and 2, the first rotating panel 210 and the third rotating panel 214 share a first common plane parallel to the plane of the third sidewall 219 while the play structure is in the use position. Similarly, the second rotating panel 212 and the fourth rotating panel 216 share a second common plane parallel to the plane of the fourth sidewall 221 while the play structure is in the use position. As depicted in FIGS. 9 and 11, the first rotating panel 210 and the second rotating panel 212 share a third common plane parallel to the plane of the first sidewall 218 when the play structure is in the storage position. Similarly, the third rotating panel 214 and the fourth rotating panel 216 share a fourth common plane parallel to the plane of the second sidewall 220 when the play structure is in the storage position. Accordingly, the first common plane is generally parallel with the second common plane in the use position, and the third common plan is generally parallel with the fourth common plane in a storage position. Similarly, the first rotating panel 210 and the third rotating panel 214, forming the third sidewall 219, and the second rotating panel 212 and the fourth rotating panel 216, forming the fourth sidewall 221, are disposed at opposite ends of center beam 222 in the use position.

Figure 3:
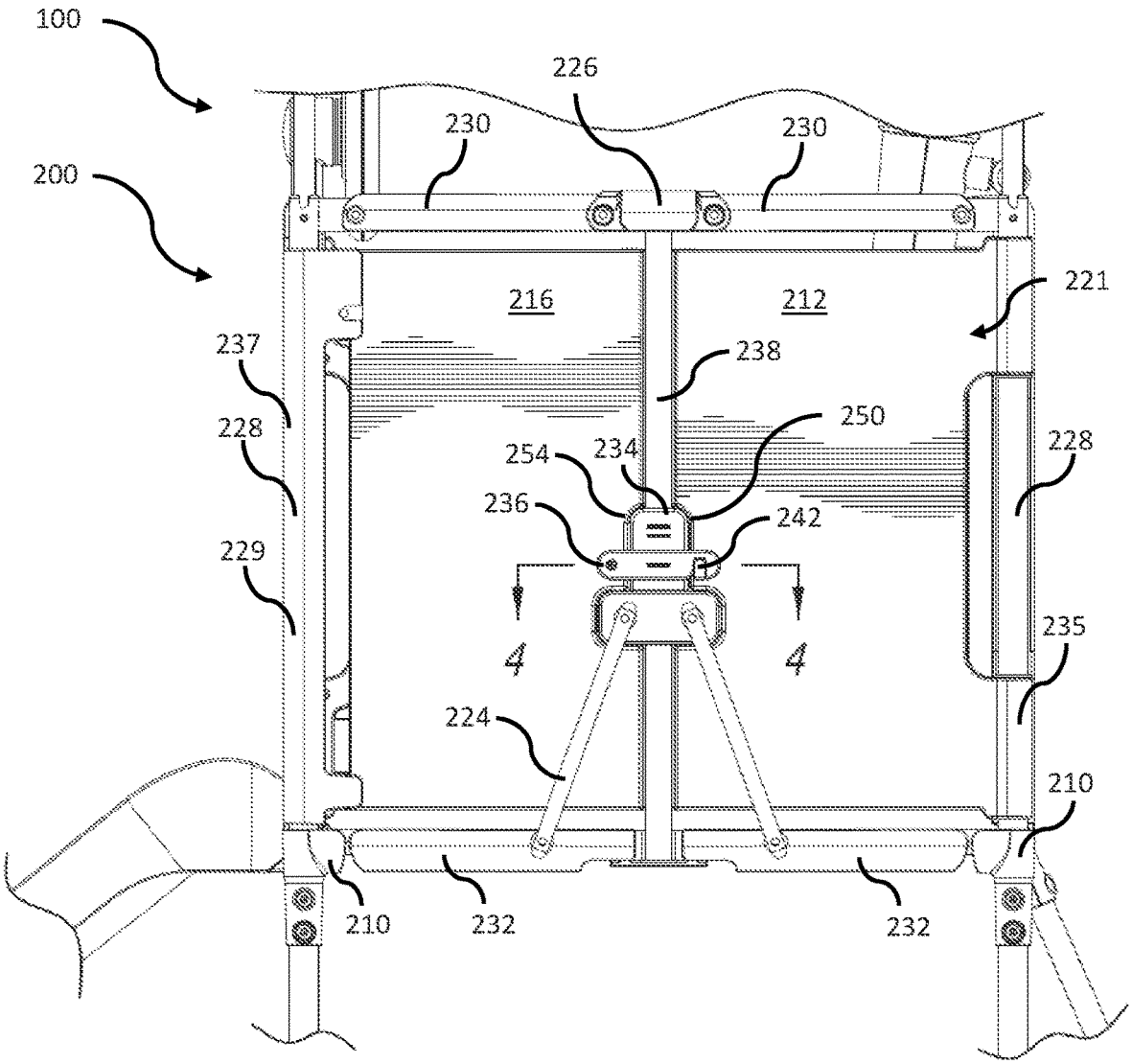
FIG. 3 is a partial side view of the main assembly of FIG. 1 in a use position according to the present disclosure.

The embodiment illustrated in FIG. 3 depicts a side view of a main assembly 200, showing the framing of the second and fourth rotating panels 212 and 216 in the plane of the fourth sidewall 221. In this view of an illustrated embodiment, it is further shown that the fourth rotating panel 216 comprises a locking arm 236, which rotates about an axis through the plane of the fourth rotating panel 216. This is similarly replicated in the plane of the third sidewall 219 (not shown in FIG. 3), with the fourth rotating panel 216 bearing a locking arm 236. In the illustrated first locking mechanism in the fourth sidewall 221, this locking arm 236 mates with a lock receiver 242 of the second rotating panel 212. The locking arm 236 covers a frame lock 234, mounted on the center frame member 238, to lock the second and fourth rotating panels 212 and 216 in the use position as shown in FIG. 3. Similarly, the first rotating panel 210 possesses a lacking arm 236 as shown in FIG. 2, and the third rotating panel 214 has a lock receiver 242, in the third sidewall 219.

In a preferred embodiment, each of rotating panels 210, 212, 214, and 216 is equipped with a corresponding panel recess: first rotating panel recess 248, second rotating panel recess 250, third rotating panel recess 252, and fourth rotating panel recess 254. These panel recesses are located on a second end of each of rotating panels 210, 212, 214, and 216, opposite vertical supports 228. As shown in FIG. 3, in the use position, the second rotating panel recess 250 receives a frame lock 234, and the fourth rotating panel recess 254 receives a frame lock 234, in the fourth sidewall 221. Similarly, as shown in FIG. 2, the first rotating panel recess 248 receives a frame lock 234, and the third rotating panel recess 252 receives a frame lock 234, in the third sidewall 219.

Figure 4:
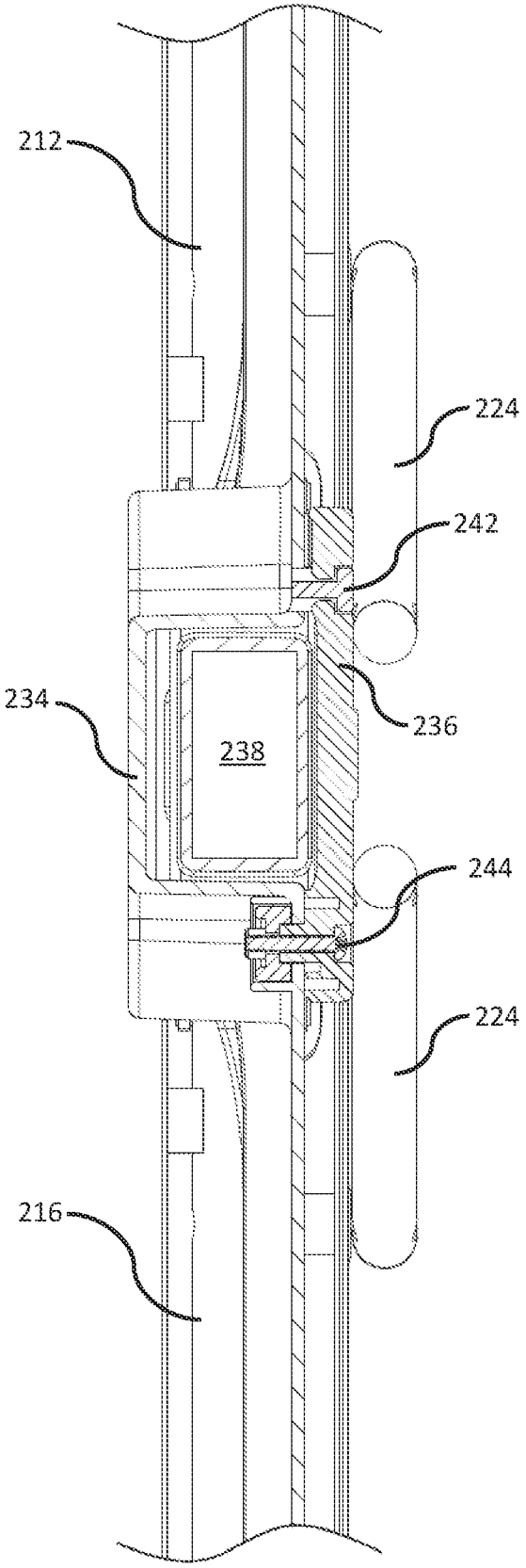
FIG. 4 is a section view of a locking assembly taken along line 4-4 of FIG. 3 according to the present disclosure.
Figure 5:
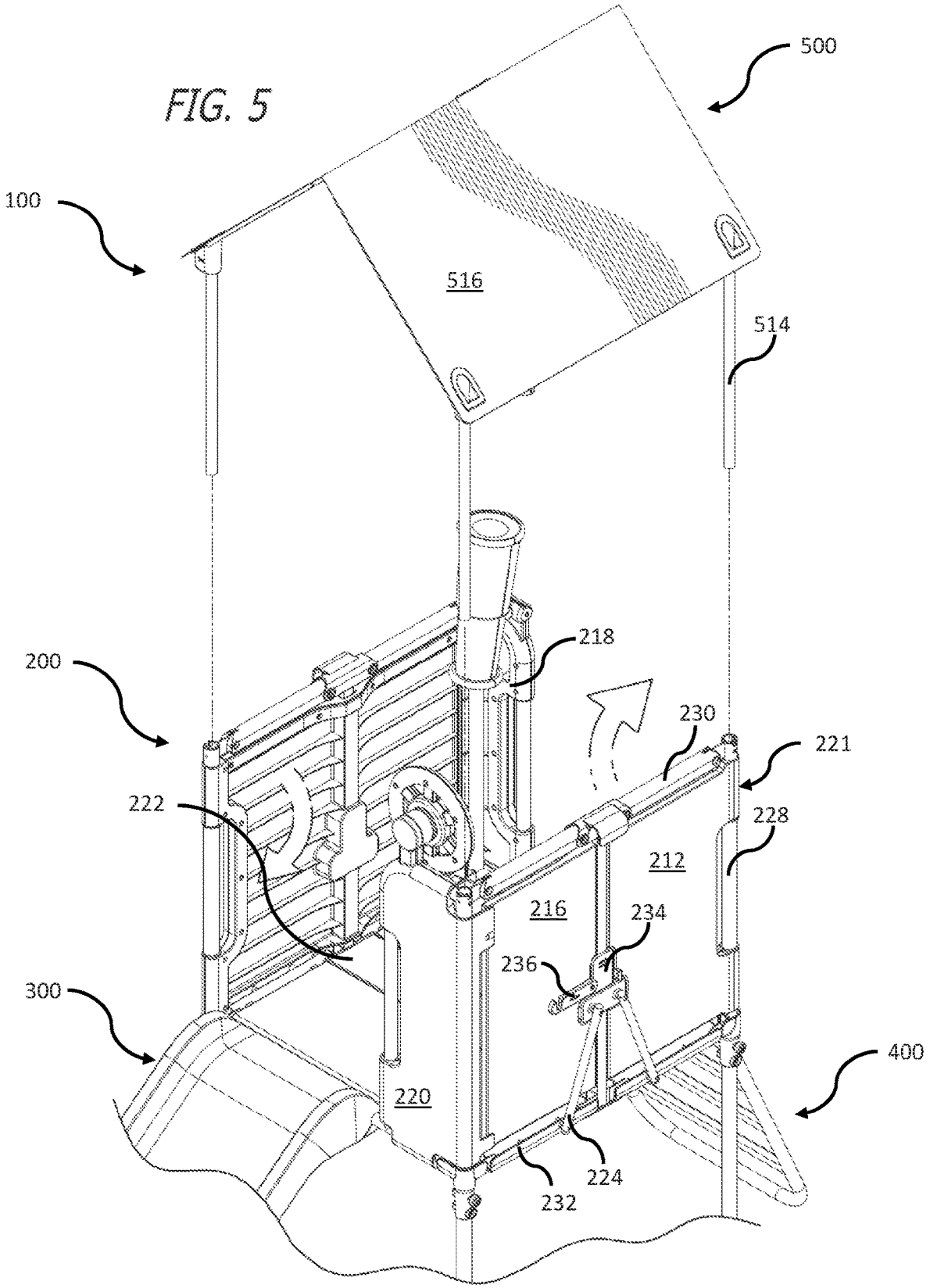
FIG. 5 is a front perspective view of a play structure in a use position showing a removable canopy according to the present disclosure.

The embodiment illustrated in FIG. 4 depicts a cross section of a first locking mechanism in the use position, showing the locking arm 236 interfacing with the lock receiver 242. FIG. 5 depicts this locking mechanism in an open configuration, wherein the locking arm 236 has been rotated about locking arm axis 244 to no longer interface with lock receiver 242. FIG. 5 further depicts an embodiment wherein the roof assembly is removeable. While the illustrated embodiment depicts this locking arm 236 and lock receiver 242 configuration, other mechanisms, such as pin fasteners, other rotating locking mechanisms, and sliding locks are contemplated for securing the rotating panels 210, 212, 214, and 216 in the use position.

Figure 6:
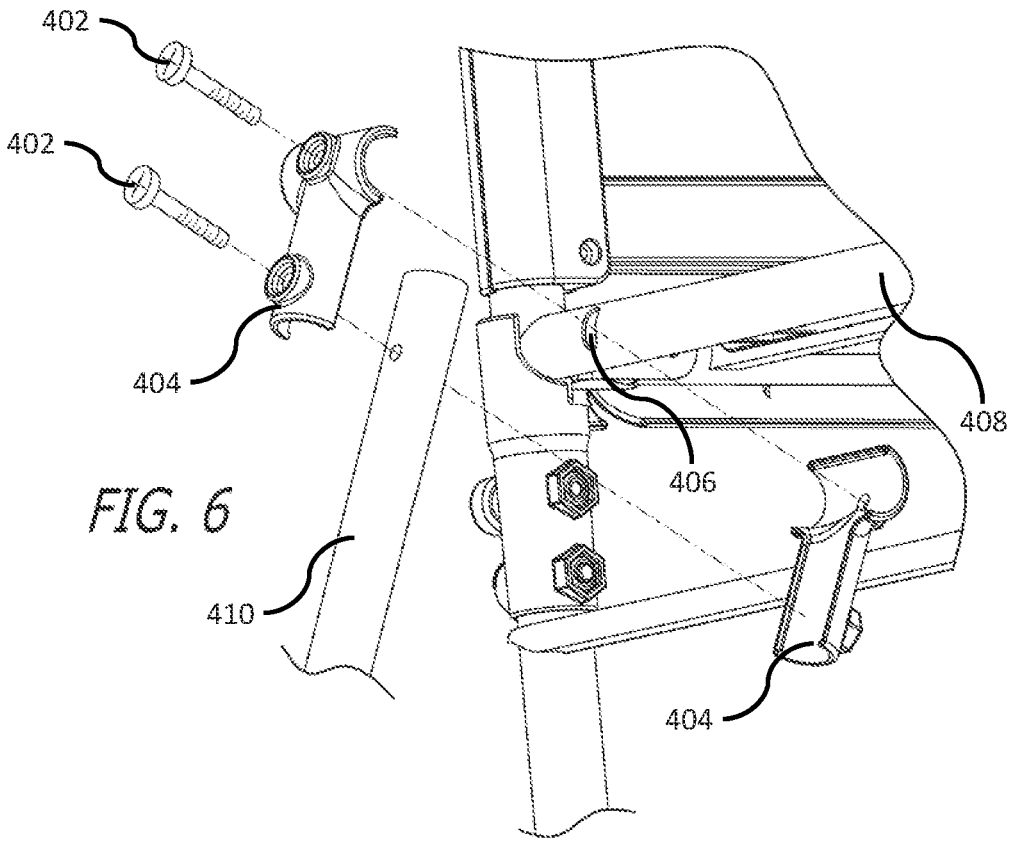
FIG. 6 is an enlarged partial exploded perspective view of a ladder pivoting mechanism according to the present disclosure.
Figure 7:
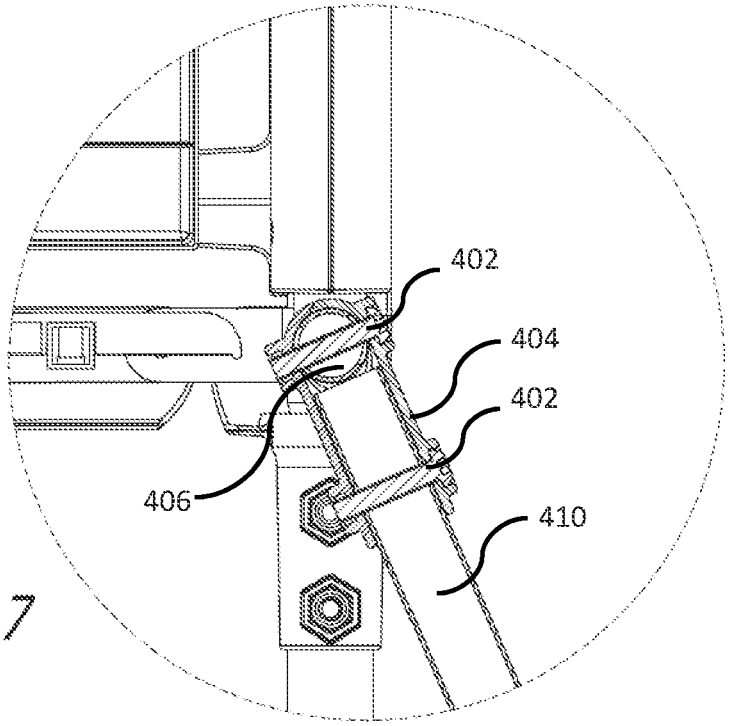
FIG. 7 is an enlarged cross-section view of the ladder pivoting mechanism of FIG. 6 according to the present disclosure.

FIG. 6 depicts an attachment mechanism for ladder assembly 400 according to at least some embodiments, showing how ladder assembly 400 rotatably interfaces with support shaft 408. Support shaft 408 has a slot or pocket 406 which pivotally receives a ladder fastener 402. Ladder fasteners 402 also serve to join fastener bracket 404 to ladder side 410, such that the ladder side 410 can pivot about the axis of the support shaft 408 within the confines of angles allowed by the length of the slot 406. FIG. 7 depicts a cross section of this mechanism assembled.

Figure 8:
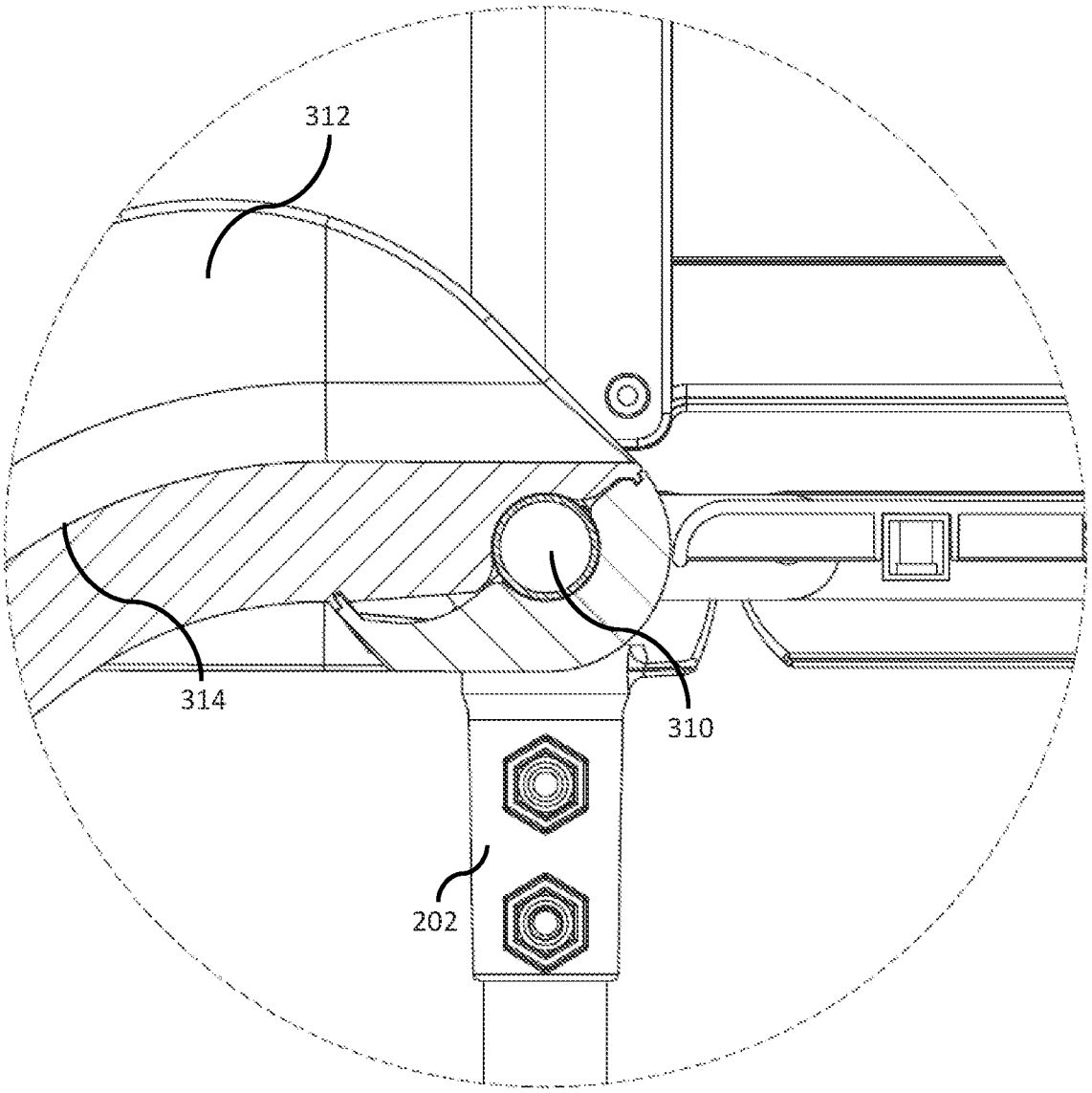
FIG. 8 is an enlarged cross-section view of a slide pivoting mechanism taken along line 8-8 of FIG. 1 according to the present disclosure.

FIG. 8 depicts a cross-section of a slide pivoting mechanism according to at least some embodiments, whereby a slide assembly 300, having a slide wall 312 and a slide surface 314 that are fit around support shaft 310 and are able to pivot about support shaft 310. The slide assembly 300 further comprises a ladder receiver 316, such as a c-clamp, that receives and retains the ladder base 414 in the storage position to assist in holding the play structure in the storage position.

Figure 12:
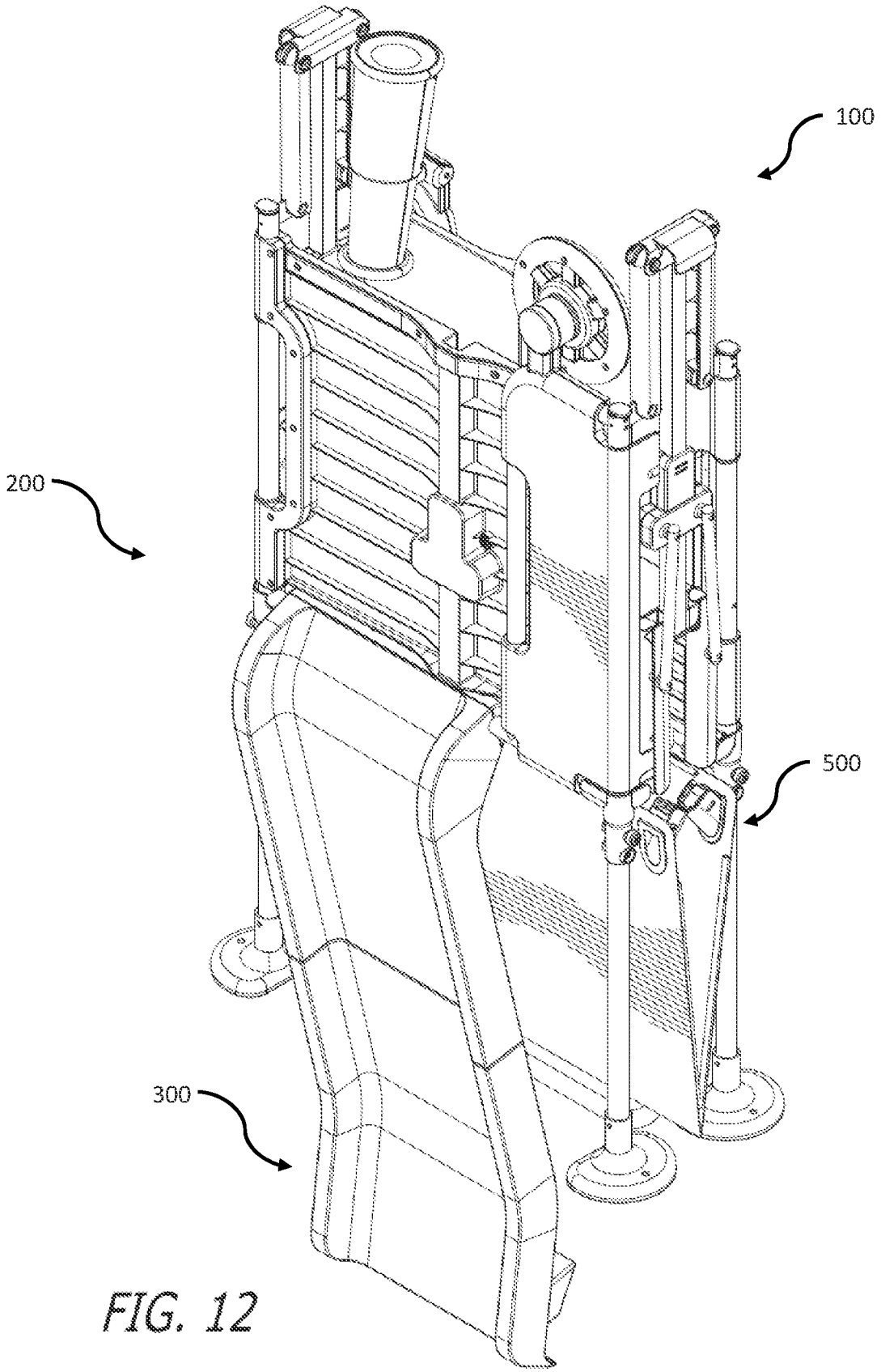
FIG. 12 is a front perspective view of the play structure of FIG. 1 in the storage position according to the present disclosure.
Figure 13:
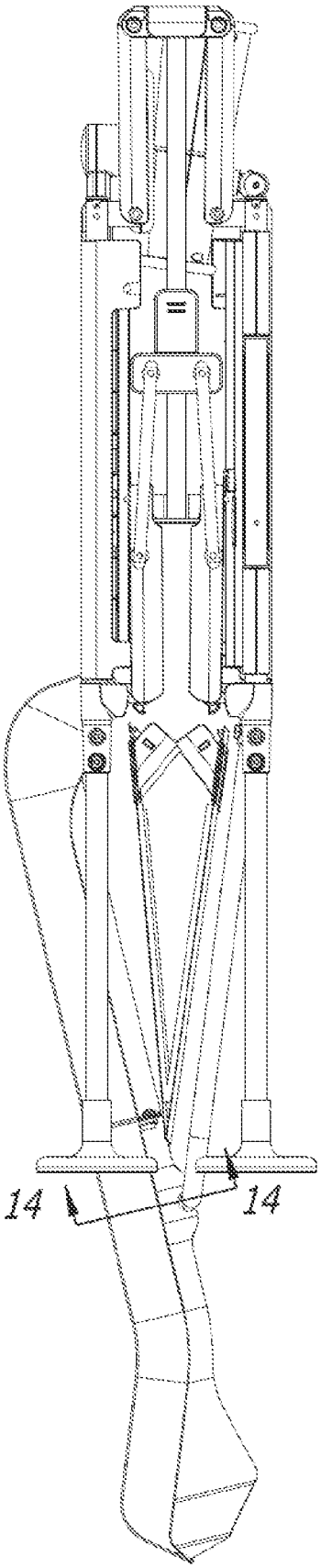
FIG. 13 is a side view of the play structure of FIG. 1 in the storage position according to the present disclosure.

The embodiment of FIG. 9 depicts the play structure 100 in a transition state between the use position of FIGS. 1 and 2 and the storage position of FIGS. 12 and 13. As shown by a combination of FIGS. 5 and 9, the transition between a use position and a storage position begins by rotating each of the rotating panels 210, 212, 214, and 216 about their respective vertical supports 228. The rotating panels 210, 212, 214, and 216 go from being framed by an upper support 230, a lower support 232, a vertical support member 228, and a center frame member 238, to being framed only by a corresponding rotating panel, the same vertical support member 228, and support shaft 408 in the case of the first rotating panel 210 and the second rotating panel 212 acting as corresponding rotating panels, and support shaft 310 in the case of the third rotating panel 214 and the fourth rotating panel 216 acting as corresponding rotating panels. These are the positions of each of the four rotating panels in the storage position.

Figure 10:
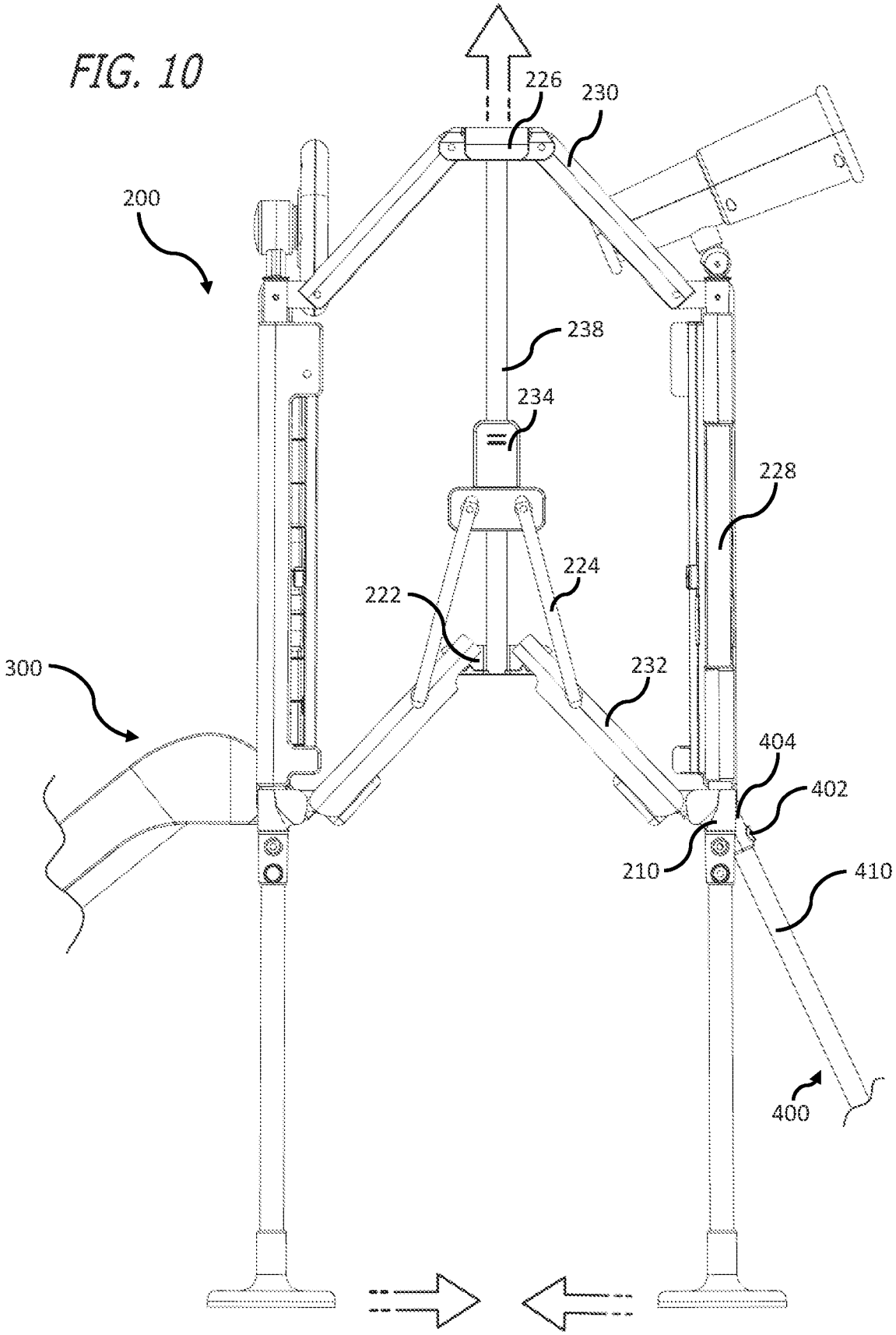
FIG. 10 is a side view of the play structure of FIG. 1 in transition from the use position to the storage position according to the present disclosure.

As can be seen in both perspective view FIG. 9 and side view FIG. 10 of this transition state, when the first, second, third, and fourth rotating panels 210, 212, 214, and 216 are in their storage position, the upper supports 230, lower supports 232, center beam 222, and center frame members 238, and vertical supports 228, are free to move relative to one another through a series of pivoting connections. Throughout these movements, as depicted by FIGS. 1-3 and 9-12, the first sidewall 218 and second sidewall 220 remain generally equidistant from the center beam 222, even when moving relative to center beam 222 and one another; further, the first sidewall 218 and second sidewall 220 are closer to the center beam 222 in the storage position than they are in the use position. The first rotating panel 210 and the second rotating panel 212, in the third common plane parallel to the plane of the first sidewall 218, and the third rotating panel 214 and the fourth rotating panel 216, in the fourth common plane parallel to the second sidewall 220, are disposed opposite one another across the axis of the center beam 222 in the storage position.

In the illustrated embodiment, to initiate the transition from the use position to the storage position, an operator will pull upwards on one or more lift handles 226, which are connected to the pair of upper supports 230, respectively. The lift handle 226 has a fixed connection to the center member 238, which further has a fixed connection to a frame lock 234. The frame lock 234 further connects to the two corresponding lower supports 232, through angled members 224. The upward movement of the lift handle 226 draws vertical supports 228, disposed on opposite sides of a plane perpendicular to center beam 222, toward one another. Similarly, the slide assembly 300 is drawn toward a ladder assembly 400. FIG. 11 depicts this transition, further showing the first sidewall 218 and the second sidewall 220 moving towards one another as the transition progresses.

Figure 14:
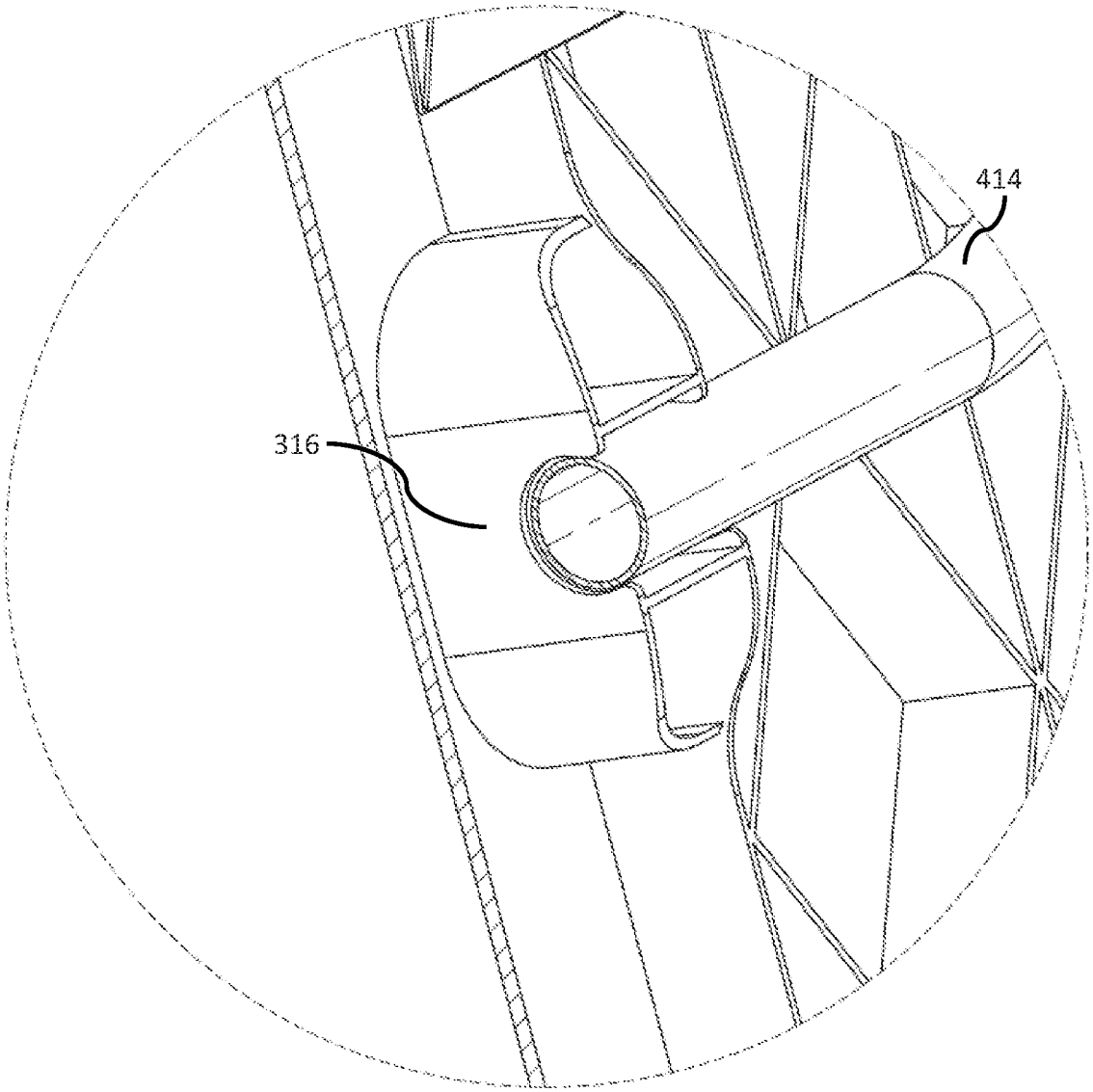
FIG. 14 is an enlarged partial perspective view of a ladder securing mechanism according to the present disclosure.

The storage position is depicted in both FIGS. 12 and 13. According to at least some embodiments, a roof assembly 500 can be stored within the folded play structure assembly 100. In the storage position, as shown in both FIGS. 13 and 14, a ladder base 414 of the ladder assembly 400 interfaces with a ladder receiver 316 of the slide assembly 300 to lock the play structure 100 in the storage position.

In order to prevent unwanted initiation of a transition from the use position to the storage position, the rotating panel recesses 248, 250, 252, and 254 receive frame locks 234. This prevents any relative motion between the upper supports 230, lower supports 232, center beam 222, and center frame members 238, and vertical supports 228. In order to keep the first, second, third, and fourth rotating panels 210, 212, 214, and 216 in place, such that the corresponding panel recesses 248, 250, 252, and 254 interface with the frame locks 234 to prevent this relative motion, a first locking mechanism comprising locking arm 236, locking arm axis 244, and lock receiver 242 fastens as depicted in FIG. 3. When this first locking mechanism is not fastened, such that locking arm 236 is rotated about locking arm axis 244 to no longer interface with lock receiver 242, each of rotating panels 210, 212, 214, and 216 are free to rotate about vertical supports 228.

In the use position, a first floor member 256 shares a fifth common plane with the center beam 222. Further, a second floor member 258 shares the same fifth common plane with the center beam 222 and the first floor member 256. The first floor member 256 is adjacent the first side wall 218, while the second floor member 258 is adjacent the second side wall 220. Both the first floor member 256 and the second floor member 258 are adjacent the center beam 222. In addition to multiple floor members 256 and 258, the play structure 100 may comprise a plurality of legs 520, which may include feet 512. Legs 520 can alternatively be connected in opposing pairs by leg connection assemblies 510, as depicted in FIGS. 15 and 16.

Figure 15:
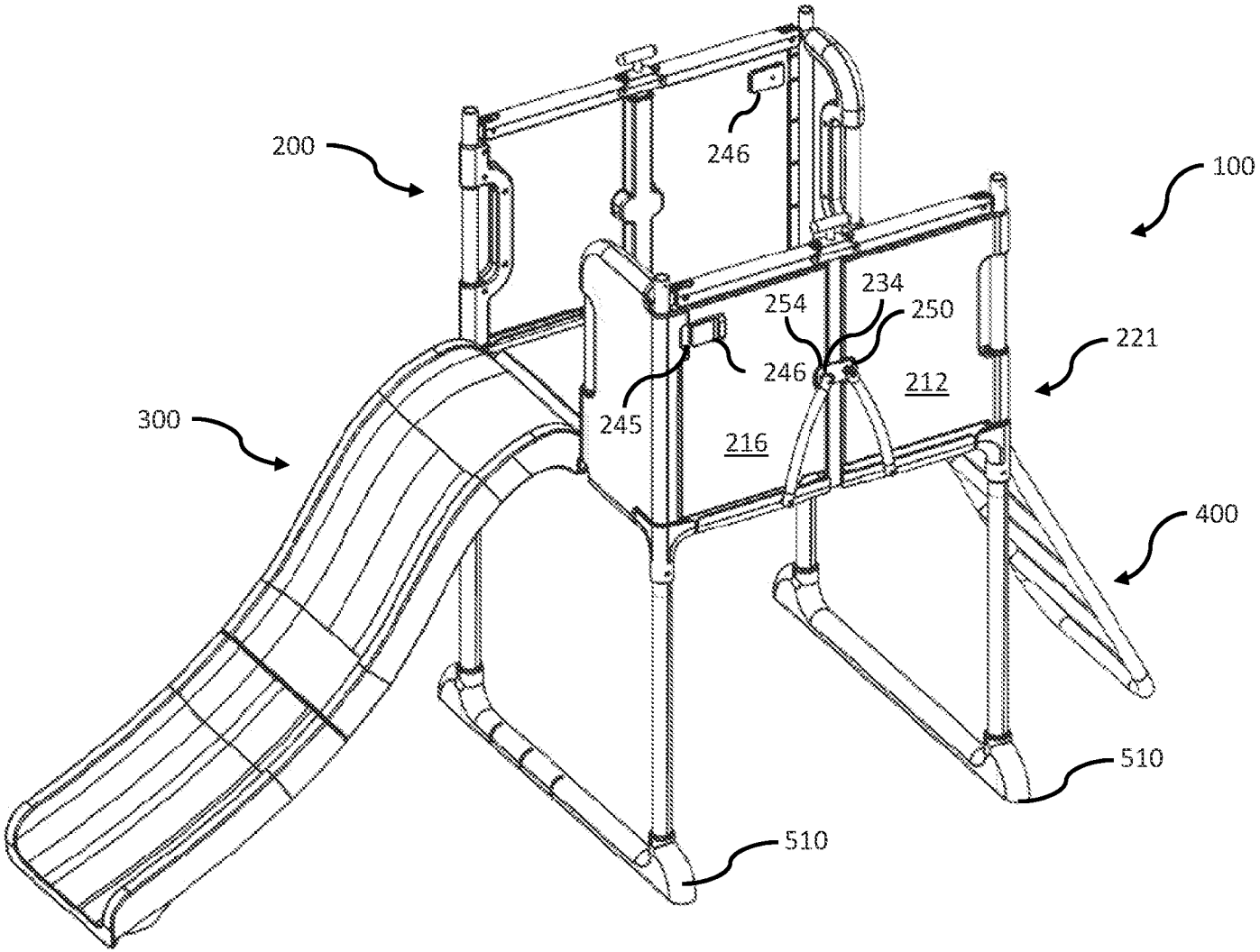
FIG. 15 is a perspective view of another play structure in a use position according to the present disclosure.
Figure 16:
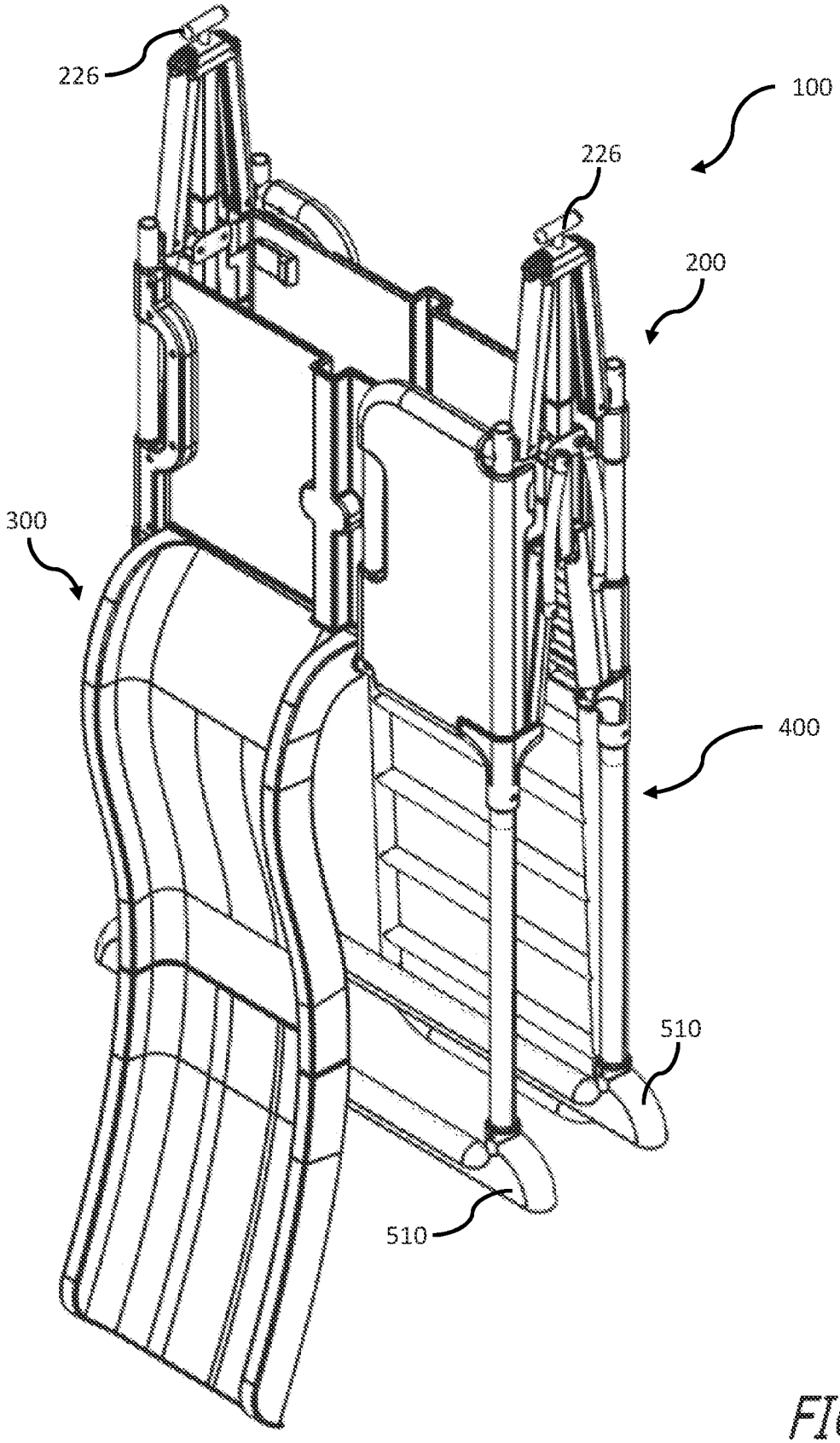
FIG. 16 is a perspective view of the play structure of FIG. 15 in a storage position according to the present disclosure.

FIGS. 15 and 16 depict an alternative embodiment of a play structure 100. FIG. 15 shows the structure in the use position, while FIG. 16 shows the structure in a storage position. In particular, the embodiment shown in FIG. 15 shows an alternative design of lift handle 226, as well as an alternative locking mechanism on the fourth sidewall 221. In this alternative locking mechanism, second rotating panel 212 and fourth rotating panel 216 still comprise panel recesses 250 and 254, which receive frame lock 234. In the alternative slide lock assembly 246, the slide lock assembly 246 is biased towards the second end 237 of the fourth sidewall 221. In the embodiment shown in FIGS. 15 and 16, the slide lock assembly 246 connects with a receiving notch 245, to prevent rotation of fourth rotating panel 216.

According to some embodiments, the roof assembly 500 includes a canopy 516 as well as a plurality of canopy supports 514. As shown in FIG. 5, canopy supports 514 may fit inside a distal end of vertical supports 228 at each corner of the play structure 100. Roof assembly 500 can take several shapes, such as the quadrilateral peaked shape shown in FIG. 5, rounded profiles, hexagonal profiles, oblong profiles, pentagonal profiles, triangular profiles, and other roof shapes. According to some embodiments, the canopy 516 must be removed before initiating the transition from a use position to a storage position, while in other embodiments the canopy 516 can fold with the rest of play structure 100.

According to some embodiments, the play structure 100 stands roughly 22 to 24 inches tall in the use position of FIG. 1, measured from the ground where foot 512 rests to the top of main assembly 200, however, the play structure may be much larger. In other or the same embodiments, first, second, third, and fourth rotating panels 210, 212, 214, and 216 are manufactured from plastics, while upper supports 230, lower supports 232, center beam 222, and center frame members 238, and vertical supports 228 are manufactured from steel, aluminum, or other suitable structural metals. According to some embodiments, locking arm 236, locking arm axis 244, and lock receiver 242 are also manufactured from structural metals, though in other embodiments these components may be manufactured from plastics or composites. In some embodiments having a roof assembly 500, the canopy 516 is made from abutting plastic panels, while in other embodiments the canopy 516 is made from cloth or composites.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the term "having" as used herein in both the disclosure and claims, is utilized in an open-ended manner.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

To the extent that the term "include," "have," or the like is used in the description or the claims, such term is intended to be inclusive in a manner similar to the term "comprise" as "comprise" is interpreted when employed as a transitional word in a claim. Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase (s) may provide one or more examples. A phrase such as an aspect or some aspects may refer to one or more aspects and vice versa, and this applies similarly to other foregoing phrases.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. Relational terms such as first and second and the like may be used to distinguish one entity or action from another without necessarily requiring or implying any actual such relationship or order between such entities or actions. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description. No claim element is to be construed under the provisions of 35 U.S.C. § 112, sixth paragraph, unless the element is expressly recited using the phrase "means for" or, in the case of a method claim, the element is recited using the phrase "step for."

While this specification contains many specifics, these should not be construed as limitations on the scope of what may be claimed, but rather as descriptions of particular implementations of the subject matter. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

Further, the claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

What is claimed is:

1. A play structure convertible between a storage position and a use position, the play structure comprising:

a first sidewall having a first end and a second end;

a second sidewall having a first end and a second end;

a third sidewall between the first end of the first sidewall and the first end of the second sidewall, the third sidewall having a first end and a second end, the third sidewall further having a first rotating panel and a third rotating panel;

a fourth sidewall between the second end of the first sidewall and the second end of the second sidewall, the fourth sidewall having a first end and a second end, the fourth sidewall having a second rotating panel and a fourth rotating panel; and, a center beam between the first sidewall and the second sidewall, wherein each of the first, second, third, and fourth rotating panels is configured to rotate about an axis of a corresponding vertical support, wherein the first rotating panel and the third rotating panel are in a first common plane when the play structure is in the use position, wherein the second rotating panel and the fourth rotating panel are in a second common plane when the play structure is in the use position, wherein the first rotating panel and the second rotating panel are in a third common plane when the play structure is in the storage position, wherein the third rotating panel and the fourth rotating panel are in a fourth common plane when the play structure is in the storage position, wherein the first common plane is generally parallel with the second common plane in the use position, wherein the third common plane is generally parallel with the fourth common plan in the storage position, and wherein one of the first rotating panel and the third rotating panel has a locking arm that is able to rotate about an axis, and wherein the other of the first rotating panel and the third rotating panel has a lock receiver configured to receive the locking arm in the use position to lock the first and the third rotating panels together in the use position.

2. The play structure of claim 1, wherein one of the second rotating panel and the fourth rotating panel has a locking arm that is able to rotate about an axis, and wherein the other of the second rotating panel and the fourth rotating panel has a lock receiver configured to receive the locking arm in the use position to lock the second and the fourth rotating panels together in the use position.

3. The play structure of claim 1, wherein each of the first, second, third, and fourth rotating panels has a recess disposed on each respective panel opposite each panel's corresponding vertical support.

4. The play structure of claim 3, wherein the recess of the first rotating panel and the recess of the third rotating panel receive a first support when the play structure is in the use position.

5. The play structure of claim 4, wherein the recess of the second rotating panel and the recess of the fourth rotating panel receive a second support when the play structure is in the use position.

6. The play structure of claim 5, wherein the first support and the second support are connected to the center beam.

7. A play structure convertible between a storage position and a use position, the play structure comprising:

a first sidewall;

a second sidewall opposing the first sidewall;

a center beam between the first sidewall and the second sidewall, wherein the first sidewall and second sidewall are disposed generally equidistant from the center beam in both the storage position and the use position; and, a plurality of panels, wherein at least two of the panels of the plurality of panels are perpendicular to a plane of the first sidewall in the use position, and wherein the at least two of the panels of the plurality of panels are parallel to the plane of the first sidewall in the storage position, and wherein each panel of the plurality of panels has a recess, wherein each panel of the plurality of panels is attached to a vertical support, and wherein the recess in each panel is disposed opposite the vertical support for each of the panels of the plurality of panels.

8. The play structure of claim 7, wherein the plurality of panels comprise a first panel, a second panel, a third panel and a fourth panel, and wherein the first and third panels are disposed at opposite ends of the center beam in the use position to the second and fourth panels.

9. The play structure of claim 7, wherein each panel of the plurality of panels is configured to rotate about an axis of a vertical support, the rotation terminating at a position of each panel in the use position and the storage position, respectively.

10. The play structure of claim 7, further comprising a third sidewall between a first end the first sidewall and a first end of the second sidewall, and a fourth sidewall between a second end of the first sidewall and a second end of the second sidewall.

11. The play structure of claim 10, wherein the third sidewall comprises a pair of upper supports, a pair of lower supports, opposing vertical supports, and a center member between the opposing vertical supports.

12. The play structure of claim 11, further comprising a handle at a top of the center member.

13. The play structure of claim 11, wherein one of the pair of upper supports, one of the pair of lower supports, one of the opposing vertical members, and the center member comprises a four bar linkage to assist in converting the play structure between the use position and the storage position.

14. The play structure of claim 11, further comprising a frame lock secured to the center member, the frame lock positioned within a recess in the panels in the use position.

15. A play structure convertible between a storage position and a use position, the play structure comprising:

a first sidewall having a first end and a second end;

a second sidewall opposing the first sidewall, the second sidewall having a first end and a second end;

a first floor member adjacent the first sidewall;

a second floor member adjacent the second sidewall;

a center beam between the first floor member and the second floor member a first foldable frame structure joining the first end of the first sidewall to the first end of the second sidewall, and a second foldable frame structure joining the second end of the first sidewall to the second end of the second sidewall, wherein at least one of the first foldable frame structure and the second foldable frame structure has a frame lock, wherein the frame lock is prevented from movement when the play structure is in the use position, and wherein the frame lock can be moved when the play structure is in the storage position; and, a ladder rotatably connected to the first sidewall in both the use position and the storage position, and a slide rotatably connected to the second sidewall in both the use position and the storage position.

16. The play structure of claim 15, wherein the first sidewall and the second sidewall are disposed generally equidistant from the center beam in both the storage position and the use position, and wherein the distance between the first sidewall and the center beam is greater in the use position than in the storage position.

17. The play structure of claim 15, further comprising a recess adjacent at least one of the first foldable frame structure and the second foldable frame structure, the recess engaging the frame lock in the use position to prevent the frame lock from movement in the use position, the recess being moved from the frame lock in the storage position to allow the frame lock to move.

* * * * *